US008047003B2

(12) United States Patent
Yoshida et al.

(10) Patent No.: US 8,047,003 B2
(45) Date of Patent: Nov. 1, 2011

(54) COMBUSTOR, GAS TURBINE COMBUSTOR, AND AIR SUPPLY METHOD FOR SAME

(75) Inventors: Shouhei Yoshida, Hitachiohta (JP); Yoshitaka Hirata, Hitachi (JP); Hiroshi Inoue, Mito (JP); Tomoya Murota, Hitachinaka (JP); Toshifumi Sasao, Mito (JP); Akinori Hayashi, Hitachinaka (JP); Isao Takehara, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 12/892,242

(22) Filed: Sep. 28, 2010

(65) Prior Publication Data

US 2011/0011092 A1 Jan. 20, 2011

Related U.S. Application Data

(62) Division of application No. 11/209,608, filed on Aug. 24, 2005, now Pat. No. 7,891,191.

(30) Foreign Application Priority Data

Sep. 2, 2004 (JP) ..... 2004-255050

(51) Int. Cl.
*F02C 7/057* (2006.01)

(52) U.S. Cl. ..... 60/740; 60/39.23; 60/748

(58) Field of Classification Search ..... 60/740, 60/748, 39.23, 800; 239/416.4, 416.5, 423, 239/424, 424.5
See application file for complete search history.

(56) References Cited

U.S. PATENT DOCUMENTS

| | | | | |
|---|---|---|---|---|
| 2,588,485 | A | | 3/1952 | Stanley et al. |
| 2,933,259 | A | | 4/1960 | Raskin |
| 3,269,377 | A | * | 8/1966 | Fleming ..... 261/39.3 |
| 3,630,024 | A | | 12/1971 | Hopkins |
| 3,728,859 | A | | 4/1973 | Seiler |
| 3,763,650 | A | | 10/1973 | Hussey et al. |
| 5,417,070 | A | | 5/1995 | Richardson |
| 5,941,075 | A | | 8/1999 | Ansart et al. |
| 6,199,367 | B1 | | 3/2001 | Howell |
| 6,474,569 | B1 | | 11/2002 | Brundish et al. |
| 6,755,024 | B1 | | 6/2004 | Mao et al. |
| 7,533,532 | B1 | | 5/2009 | Toon et al. |

FOREIGN PATENT DOCUMENTS

| | | |
|---|---|---|
| JP | 52-145832 | 12/1977 |
| JP | 2000-39148 | 2/2000 |
| JP | 2003-148734 | 5/2003 |
| JP | 2003-175030 | 6/2003 |

OTHER PUBLICATIONS

Office Action in Japanese Patent Application No. 2004-255050, mailed May 12, 2009.

* cited by examiner

*Primary Examiner* — Ehud Gartenberg
*Assistant Examiner* — Vikansha Dwivedi
(74) *Attorney, Agent, or Firm* — Brundidge & Stanger, P.C.

(57) ABSTRACT

A combustor comprises a liquid fuel nozzle for injecting liquid fuel to a combustion chamber, and an air supply nozzle disposed around the liquid fuel nozzle and injecting air. The air supply nozzle is disposed such that air is injected from the air supply nozzle in a direction toward an axis of the liquid fuel nozzle. A space is formed around an outlet of the liquid fuel nozzle, through which the liquid fuel is injected from the liquid fuel nozzle to the combustion chamber, upstream of a distal end of the outlet in a direction in which the liquid fuel is injected. Carbonaceous deposits on surrounding surfaces of the outlet of the liquid fuel nozzle can be suppressed regardless of the operating conditions of a combustor.

3 Claims, 7 Drawing Sheets

COMBUSTOR, GAS TURBINE COMBUSTOR, AND AIR SUPPLY METHOD FOR SAME

This application is a divisional application of U.S. application Ser. No. 11/209,608, filed Aug. 24, 2005, now U.S. Pat. No. 7,891,191 the entirety of which is incorporated herein by reference.

BACKGROUND OF THE INVENTION

1. Field of the Invention

The present invention relates to a combustor, a gas turbine combustor, and an air supply method for the combustor.

2. Description of the Related Art

With liberation of electric power, recent environments of power generation business shift toward increasing use of decentralized power supplies with medium and small capacities in addition to conventional large-scaled power stations with large capacities. Many of power plants with medium and small capacities employ liquid fuel that is relatively easy in handling for supply of the fuel. However, a combustor employed in the power plant using the liquid fuel accompanies the problem that the liquid fuel is deposited as carbon around a liquid fuel nozzle, and the carbon deposits adversely affect an atomization spray of the liquid fuel and a flow of air.

According to Patent Document 1; JP,A 2000-39148, a main unit of a liquid fuel nozzle is disposed substantially at the axis of a combustion burner, and an air supply nozzle for injecting air for combustion to an outlet of the liquid fuel nozzle is circumferentially disposed around the liquid fuel nozzle. Downstream of the air supply nozzle, a guide ring is disposed to deflect a flow of air toward the outlet of the liquid fuel nozzle. Fuel supplied to the liquid fuel nozzle is injected from the outlet of the liquid fuel nozzle and is burnt in a combustion chamber after being mixed with the combustion air introduced through a swirler in the combustion burner. In the combustion burner disclosed in Patent Document 1, the airflow injected from the air supply nozzle has an effect of preventing droplets of the fuel injected through the outlet of the liquid fuel nozzle from being deposited on a nozzle end face, and the provision of the guide ring contributes to increasing that effect.

SUMMARY OF THE INVENTION

However, because components of the liquid fuel nozzle and the air supply nozzle are susceptible to thermal elongations depending on operating conditions of the combustor, the positional relationship between the outlet of the liquid fuel nozzle and an injection hole of the air supply nozzle is not constant. Depending on the positional relationship between the liquid fuel nozzle and the air supply nozzle, therefore, a circulation flow acting to collide a part of small fuel droplets injected through the outlet of the liquid fuel nozzle against surrounding surfaces of the outlet of the liquid fuel nozzle is generated by an action of the airflow injected from the air supply nozzle in a flow stagnation zone, such as an outlet area of the air supply nozzle and an area where the air supply nozzle is not disposed. The liquid fuel having collided and deposited on the surrounding surfaces of the outlet of the liquid fuel nozzle while being carried with the circulation flow is carbonized and deposited as carbon (carbonaceous deposits). If the amount of carbonaceous deposits increases, there arises a possibility that the deposits impede the airflow injected from the air supply nozzle or deteriorate injection characteristics of the liquid fuel nozzle, thus resulting in degradation of the combustion performance.

It is an object of the present invention to suppress carbonaceous deposits on surrounding surfaces of the outlet of the liquid fuel nozzle regardless of the operating conditions of a combustor.

To achieve the above object, according to the present invention, an air supply nozzle is disposed such that air is injected from an air supply nozzle in a direction toward an axis of a liquid fuel nozzle, and a space is formed around an outlet of the liquid fuel nozzle, through which liquid fuel is injected from the liquid fuel nozzle to a combustion chamber, upstream of a distal end of the outlet in a direction in which the liquid fuel is injected.

With the present invention, carbonaceous deposits on surrounding surfaces of the outlet of the liquid fuel nozzle can be suppressed regardless of the operating conditions of a combustor.

DESCRIPTION OF THE PREFERRED EMBODIMENTS

As mentioned above, components of a liquid fuel nozzle and an air supply nozzle both disposed in a combustion burner are susceptible to thermal elongations depending on operating conditions of a combustor. When a combustion burner is used in a gas turbine combustor as one example of applications, the combustion burner is operated under a variety of operating conditions from the startup of a gas turbine to the operation at a base load and is subjected to a variety of pressure and temperature environments. Therefore, respective components of the combustion burner, the liquid fuel nozzle, etc. are particularly susceptible to thermal elongations depending on the operating conditions of the gas turbine.

Figure 2:
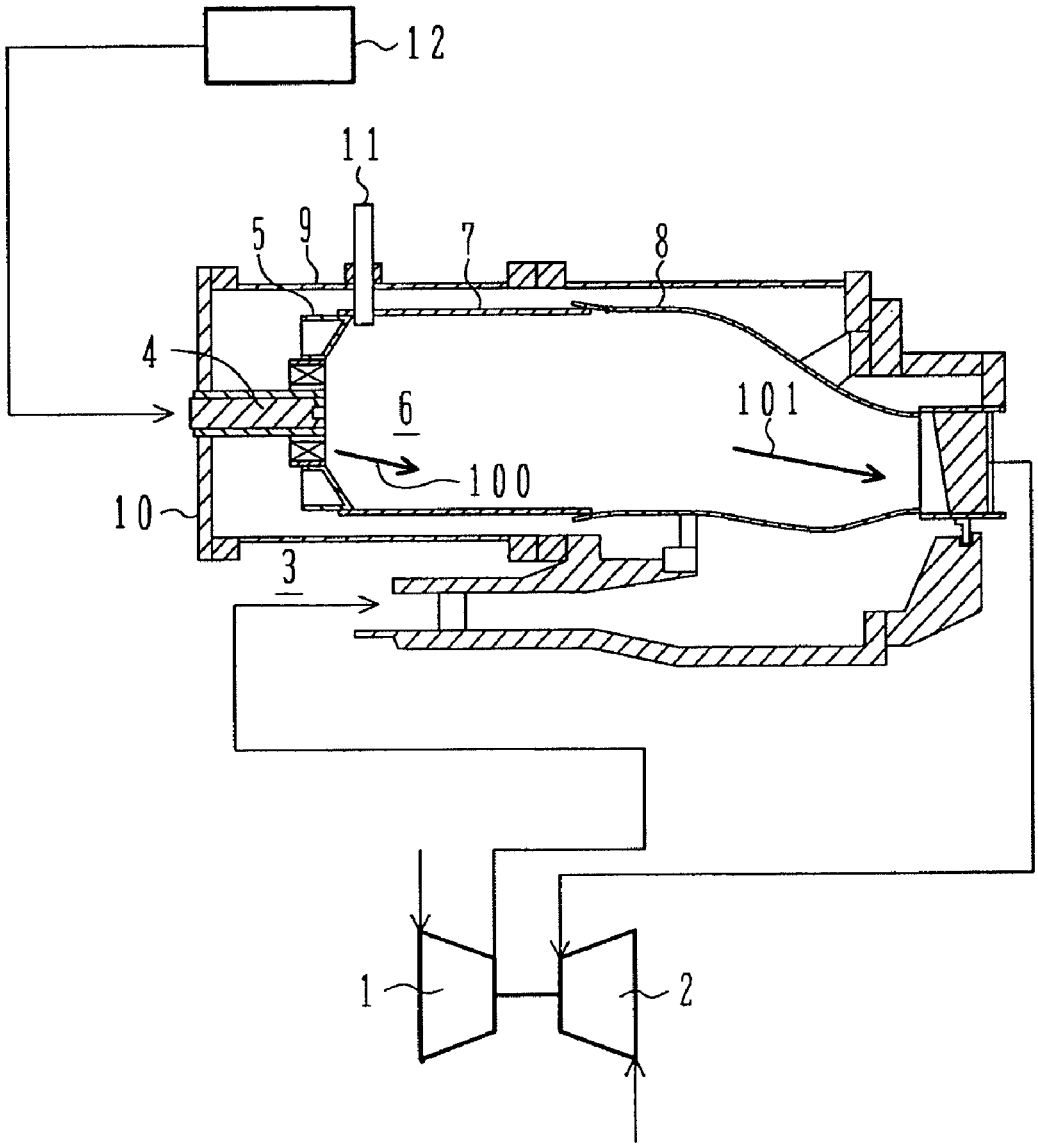
FIG. 2 shows, in a side sectional view, a construction of a gas turbine combustor according to the first embodiment and also shows, in a schematic view, an overall construction of a gas turbine plant.

FIG. 2 shows, in a side sectional view, a construction of a gas turbine combustor and also shows, in a schematic view, an overall construction of a gas turbine plant including the gas turbine combustor. As shown in FIG. 2, the gas turbine plant mainly comprises a compressor 1 for compressing air to produce high-pressure air for combustion, a combustor 3 for mixing and burning the combustion air introduced from the compressor 1 and fuel, to thereby produce combustion gases, and a turbine 2 to which the combustion gases produced by the combustor 3 are supplied. The compressor 1 and the turbine 2 are coupled to each other by one rotating shaft.

The combustor 3 comprises a liquid fuel nozzle 4 for injecting liquid fuel to a combustion chamber 6 located on the downstream side, an air supply nozzle 15 (see FIG. 1) for injecting air for combustion from the side around the liquid fuel nozzle 4, a combustion burner 5 for mixing the combustion air and the fuel with each other, the combustion chamber 6 for burning a gas mixture of the liquid fuel and the combustion air therein to produce combustion gases, a liner 7 defining the combustion chamber 6 therein, a transition piece 8 for introducing the combustion gases from the liner 7 to the turbine 2, a casing 9 and an enclosing plate 10 cooperatively accommodating the combustion burner 5, the liner 7 and the transition piece 8 in a gastight manner, an igniter 11 supported by the casing 9 and igniting the gas mixture in the combustion chamber 6, and a liquid fuel supply system 12 serving as means for supplying the liquid fuel to the liquid fuel nozzle 4.

In the combustor 3, as indicated by an arrow 100 in FIG. 2, the combustion air produced as compressed air by the compressor 1 is mixed with the fuel introduced from the combustion burner 5, thereby producing a gas mixture. The gas mixture is ignited by the igniter 11 for burning in the combustion chamber 6. The combustion gases produced with the burning of the gas mixture flows in a direction indicated by an arrow 101 in FIG. 2. Then, the combustion gases are ejected toward the turbine 2 through the transition piece 8 to drive the turbine 2. A generator coupled to the turbine 2 is thereby driven for generation of electric power. Note that, in this embodiment, the side near the liquid fuel nozzle 4 in the combustion chamber 6 is assumed to be the upstream side and the side near the turbine 2 through which the combustion gases flow is assumed to be the downstream side.

Figure 3:
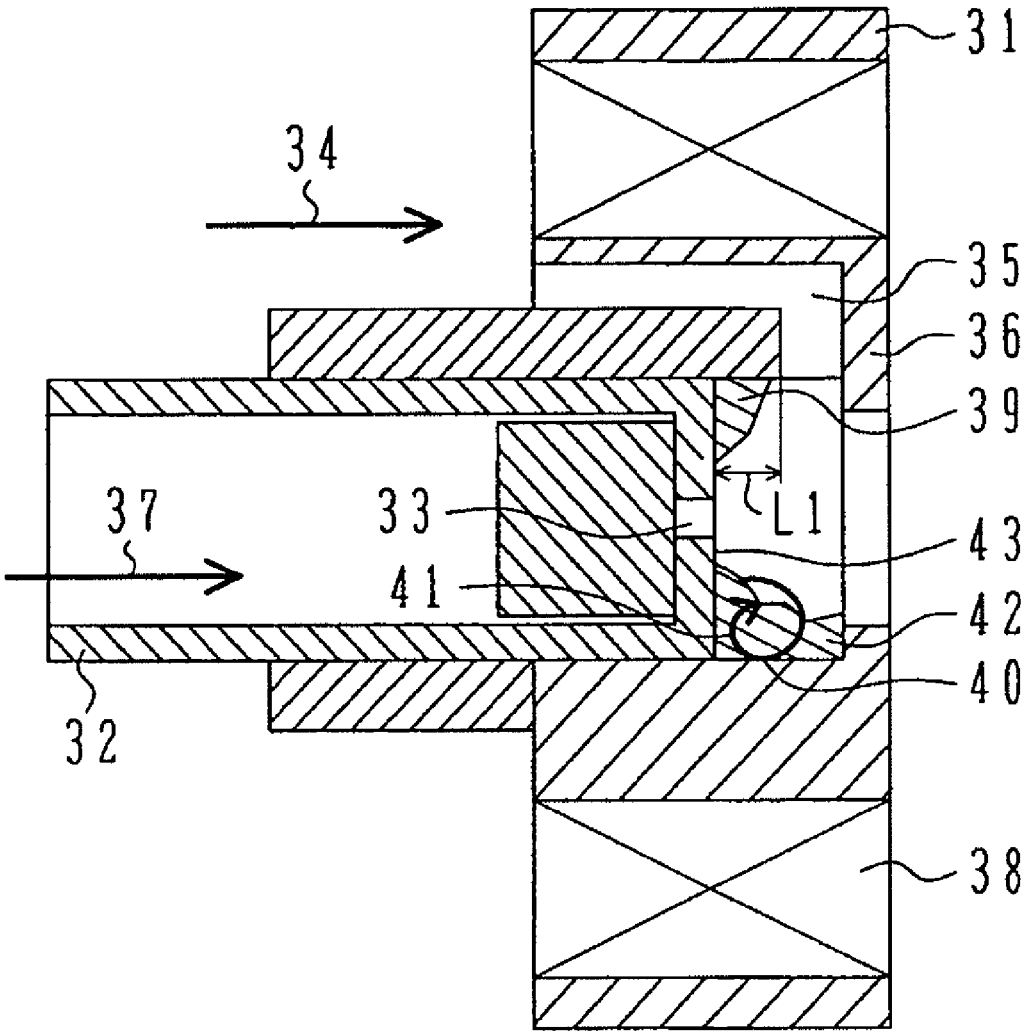
FIG. 3 is a side sectional view showing, as Comparative Example 1, a detailed structure of a combustion burner when a gas turbine operates at a base load.

The operating state of a combustion burner at the startup of a gas turbine or under operation at a base load will be described below in connection with the case where an outlet for injecting the liquid fuel therethrough is formed so as not to project from a nozzle cover and to be located in the nozzle cover. FIG. 3 shows, as Comparative Example 1, the operating state of the combustion burner when the gas turbine operates at the base load. In Comparative Example 1, the combustion burner is constructed such that, between an injection hole of an air supply nozzle 35 in a combustion burner 31 and a downstream end face 43 of a liquid fuel nozzle 32, a distance L1 (created under the operation at the base load as shown) is not formed at the startup of the gas turbine.

Generally, the temperature of the liquid fuel is 20-30° C., and the liquid fuel is in a state at temperature lower than the compressed combustion air at high temperatures. The temperature of the compressed combustion air is usually not lower than 200° C. Therefore, a component of the liquid fuel nozzle 32 to which the liquid fuel is supplied is in a state at temperature lower than the compressed combustion air. On the other hand, a component of the combustion burner 31, in which the air supply nozzle 35 is formed, is exposed to the high-temperature combustion air and hence comes into a state at temperature higher than the component of the liquid fuel nozzle 32. Accordingly, the air supply nozzle 35 constituting the combustion burner 31 and the liquid fuel nozzle 32, which are supported by the enclosing plate 10 (FIG. 2) on the upstream side of a combustor, are forced to elongate toward the downstream side of the combustor with thermal elongations. However, the air supply nozzle 35 and the liquid fuel nozzle 32 are elongated in different amounts in the axial direction of the nozzles depending on the temperature difference between them. Further, the combustion burner 31 and the liquid fuel nozzle 32 are fixed to the enclosing plate 10 on the upstream side of the combustor, but they are not fixed to any other parts than the enclosing plate 10. With such an arrangement, the liquid fuel nozzle 32 is movable in the axial direction thereof relative to the air supply nozzle 35 in the combustion burner 31. For that reason, under the operation of the gas turbine at the base load, the distance L1 is created with the thermal elongations between the downstream end face 43 of the liquid fuel nozzle 32 and the injection hole of the air supply nozzle 35 in the combustion burner 31. As a result, a flow stagnation zone is formed in a space surrounded by the downstream end face 43 of the liquid fuel nozzle 32, a swirler constituted by the injection hole of the air supply nozzle 35, and the guide ring 36.

In the flow stagnation zone, a circulation flow is generated due to an airflow injected from the air supply nozzle 35. Therefore, in the case where an outlet 33 for injecting the liquid fuel therethrough is formed so as not to project from a nozzle cover and to be located in the downstream end face 43 of the liquid fuel nozzle 32, small droplets of the liquid fuel injected through the outlet 33 collide against surrounding surfaces of the outlet 33 of the liquid fuel nozzle 35 in areas 39 and 40 near the outlet 33 of the air supply nozzle 35, whereby carbon 42 is deposited there.

Figure 4:
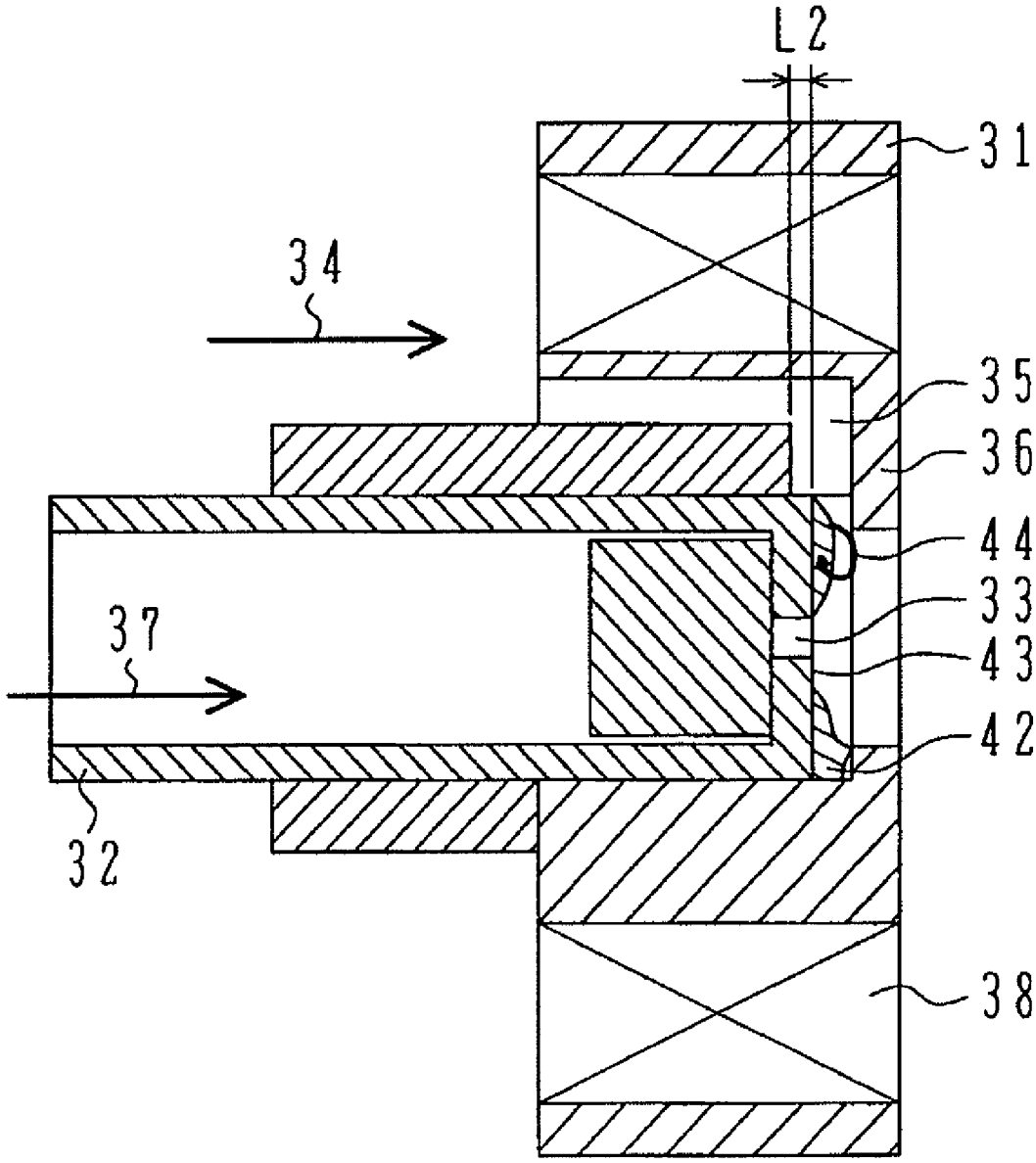
FIG. 4 is a side sectional view showing, as Comparative Example 2, a detailed structure of a combustion burner when the gas turbine is started up.

Next, let look at Comparative Example 2 in which the liquid fuel nozzle 32 is disposed to project downstream by a distance L2 in a state before the start of the operation so that the distance L1, shown in FIG. 3, is not created between the injection hole of the air supply nozzle 35 in the combustion burner 31 and the downstream end face 43 of the liquid fuel nozzle 32 under the operation at the base load. FIG. 4 shows the operating state of the combustion burner in Comparative Example 2 when the gas turbine is started up. In Comparative Example 2, under the operation at the base load, the flow stagnation zone is not generated and carbonaceous deposits are suppressed. At the startup of the gas turbine or under the operation at a low load, however, the air injected from the air supply nozzle 35 collides against the liquid fuel nozzle 32, thereby generating a circulation flow 44 at an edge of the liquid fuel nozzle 32. Small droplets of the liquid fuel injected through the outlet 33 are carried with the circulation flow 44 and collide against the downstream end face 43 of the liquid fuel nozzle 35, whereby carbon 42 is deposited there.

As described above, the difference in thermal elongation between the components causes the flow stagnation zone where the liquid fuel collides against the surrounding surfaces of the outlet of the liquid fuel nozzle, thus resulting in a larger amount of carbonaceous deposits. On the other hand, it is impossible to hold the positional relationship between the combustion burner and the liquid fuel nozzle in an ideal state under all the operating conditions, thus resulting in a difficulty in suppressing the carbonaceous deposits under all the operating conditions. Further, if one or more injection holes of the air supply nozzle are partly closed, the airflow is changed to form a new circulation flow, which promotes deposition of carbon. Then, the carbon deposited at the outlet of the liquid fuel nozzle and on the surrounding surfaces thereof deteriorates injection characteristics of the liquid fuel nozzle and adversely affects the combustion performance.

The detailed structure of the combustion burner applied to the gas turbine combustor according to the present invention will be described below in connection with the following embodiments.

First Embodiment

Figure 1:
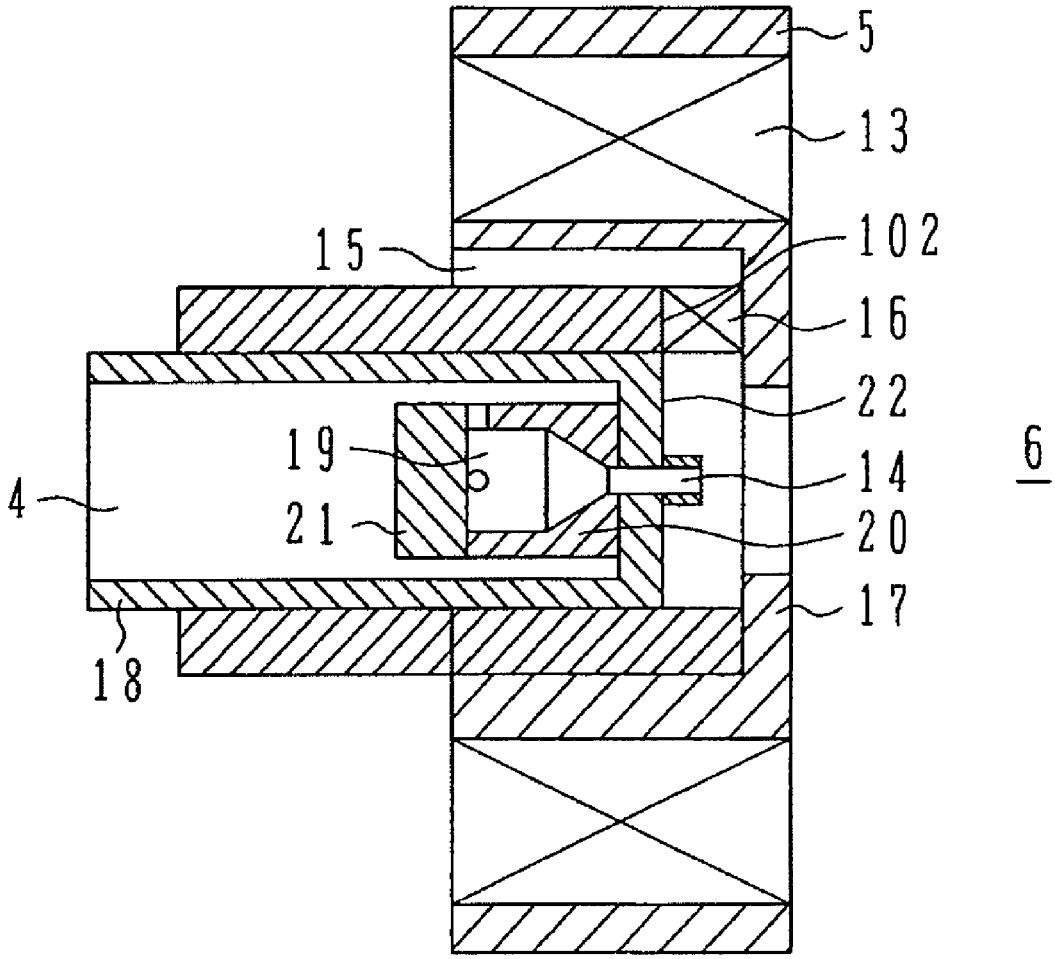
FIG. 1 is a side sectional view showing a detailed structure of a combustion burner according to a first embodiment of the present invention.

FIG. 1 is a side sectional view showing the detailed structure of the liquid fuel nozzle 4 and the combustion burner 5 according to a first embodiment. As shown in FIG. 1, the combustion burner 5 includes a swirler 13 acting to give a swirl component to the combustion air supplied to the combustion chamber 6, and the air supply nozzle 15 for blowing a part of the combustion air toward an outlet 14 of the liquid fuel nozzle 4. Also, a swirler 16 is formed as an injection hole at an outlet of the air supply nozzle 15 such that a swirl component acts on the combustion air injected from the air supply nozzle 15 in the circumferential direction about the axis of the liquid fuel nozzle 4. Further, the combustion air is injected from the air supply nozzle 15 in a direction toward the axis of the liquid fuel nozzle 4. In this embodiment, the air injecting direction from the air supply nozzle 15 is set substantially perpendicular to the axis of the liquid fuel nozzle 4. An annular guide ring 17 is disposed downstream of the swirler 16, and a center area of the guide ring 17 is opened, thus allowing the fuel injected from the liquid fuel nozzle 4 to be injected to the combustion chamber 6.

The liquid fuel nozzle 4 is of the so-called pressure swirl injector structure comprising a nozzle tip 20 including a swirl chamber 19 formed therein to give a swirl component to the liquid fuel, a nozzle cover 18 for covering the nozzle tip 20, and a nozzle stay 21. The outlet 14 of the liquid fuel nozzle 4 (or the liquid fuel outlet 14) is formed as a portion of a downstream end wall surface 22 of the nozzle cover 18 in communication with the downstream side of the swirl chamber 19 in the nozzle tip 20, the downstream end wall surface 22 being located to face the entry side of the combustion chamber 6, and the outlet 14 is projected from the downstream end wall surface 22 of the nozzle cover 18. In other words, the outlet 14 is formed to provide an injection hole spaced at a desired distance in the axial direction of the liquid fuel nozzle 4 downstream of the downstream end wall surface 22 of the nozzle cover 18 located to face the entry side of the combustion chamber 6. Then, a space is formed around the outlet 14 of the liquid fuel nozzle 4 upstream of a distal end of the outlet 14 in the direction in which the liquid fuel is injected.

In this embodiment, the outlet 14 is formed such that, at the startup of the gas turbine, it is projected until a position corresponding to the axis (indicated by a one-dot-chain line in FIG. 1) of the swirler 16 formed at the outlet of the air supply nozzle 15. Stated another way, the outlet 14 provides an injection hole of the liquid fuel nozzle 4, which is formed at the outlet distal end located in a position substantially crossing an extension of the axis of the air supply nozzle 15.

The operation and advantages of the first embodiment will be described below.

In this embodiment, the air supply nozzle 15 is disposed to direct the air injected from the air supply nozzle 15 toward the axis of the liquid fuel nozzle 4, and a space is formed around the outlet 14, through which the liquid fuel is injected from the liquid fuel nozzle 4 into the combustion chamber 6, upstream of the outlet distal end, i.e., on the backward side opposed to the direction in which the liquid fuel is injected. Therefore, carbonaceous deposits on the surrounding surfaces of the outlet of the liquid fuel nozzle can be suppressed regardless of the operating conditions of the combustor. More specifically, a level difference in the axial direction of the liquid fuel nozzle 4 is given between the top and root of a projection forming the fuel injecting outlet 14 of the liquid fuel nozzle 4 along the outer periphery thereof. Accordingly, an annular space is formed so as to surround the outer periphery of the outlet 14, and the combustion air injected from the air supply nozzle 15 is blown into the annular space.

The operation of this embodiment will be described in more detail. At the startup of the gas turbine, as shown in FIG. 1, the liquid fuel nozzle 4 is disposed such that the flow stagnation zone is not formed between the downstream end wall surface 22 of the nozzle cover 18 of the liquid fuel nozzle 4 and the swirler 16 formed as the injection hole of the air supply nozzle 15 of the combustion burner 5. Stated another way, the position of the downstream end wall surface 22 around the outlet 14 of the liquid fuel nozzle 4 and the position of an upstream end face 102 of the injection hole of the air supply nozzle 15 are substantially coincident with each other in the axial direction of the liquid fuel nozzle 4. A degree of the coincidence between the position of the downstream end wall surface 22 around the outlet 14 of the liquid fuel nozzle 4 and the position of the upstream end face 102 of the injection hole of the air supply nozzle 15 may be allowed to such an extent that neither a circulation flow nor a circulation flow are caused around the outlet 14 by the air injected from the air supply nozzle 15. Then, because the space is formed around the outlet 14 of the liquid fuel nozzle 4 upstream of the outlet distal end in the injecting direction of the liquid fuel, the combustion air injected from the air supply nozzle 15 swirls in the space about the axis of the liquid fuel nozzle 4. The combustion air swirling along wall surfaces defining the space acts to suppress deposition of the liquid fuel droplets on the surrounding surfaces of the outlet 14 (i.e., in the space).

Further, since the surrounding surfaces of the outlet 14 of the liquid fuel nozzle 4 form the space upstream of the outlet distal end in the injecting direction of the liquid fuel, the distal end of the outlet 14 is not flush with the downstream end wall surface 22 and has a level difference in the axial direction between the top and root of the projection forming the outlet 14. In other words, the downstream end wall surface 22 of the liquid fuel nozzle 4 around the outlet 14 is recessed relative to the projection forming the outlet 14 therein. With such an arrangement of the outlet distal end projecting by a desired distance from the downstream end wall surface 22, the liquid fuel droplets injected through the outlet are suppressed from flowing toward the downstream end wall surface 22. As a result, it is possible to suppress the liquid fuel droplets from depositing on the surrounding surfaces of the outlet 14 and forming carbonaceous deposits.

Under the operation of the gas turbine at the base load, the flow stagnation zone is formed and a circulation flow is generated therein due to the difference in thermal elongation between the combustion burner 5 and the liquid fuel nozzle 4. More specifically, as shown in FIG. 3, the combustion burner 5 shows a larger thermal elongation than the liquid fuel nozzle 4 downstream in the axial direction of the liquid fuel nozzle 4. Therefore, the flow stagnation zone for the combustion air injected from the air supply nozzle 15 is formed around the outlet 14 of the liquid fuel nozzle 4. In the flow stagnation zone, the combustion air collides against the downstream end wall surface 22 of the liquid fuel nozzle 4 around the outlet 14. With such a condition in mind, in this embodiment, the outlet 14 of the liquid fuel nozzle 4 is formed to project downstream by a desired distance from the downstream end wall surface 22 of the liquid fuel nozzle 4 so that the space is formed around the outlet 14 of the liquid fuel nozzle 4 upstream of the outlet distal end in the direction in which the liquid fuel is injected. Because of the space being formed around the outlet 14 of the liquid fuel nozzle 4 upstream of the outlet distal end in the injecting direction of the liquid fuel, a circulation flow of the combustion air is generated in the space recessed relative to the outlet distal end. Accordingly, the outlet 14 of the liquid fuel nozzle 4 is positioned downstream of the circulation flow, and the liquid fuel droplets can be suppressed from being carried with the circulation flow into the flow stagnation zone. Thus, by forming the space around the outlet 14 of the liquid fuel nozzle 4 upstream of the outlet distal end in the injecting direction of the liquid fuel, it is possible to suppress carbonaceous deposits on the surrounding surfaces of the outlet of the liquid fuel nozzle and to maintain combustion stability under the operation of the gas turbine at the base load as well.

Further, in this embodiment, the outlet distal end of the liquid fuel nozzle 4 is located in a position substantially crossing the extension of the axis of the air supply nozzle 15 so that the outlet 14 of the liquid fuel nozzle 4 just intersects the direction in which the air is injected from the air supply nozzle 15. With such an arrangement, a main flow of the air injected through the swirler 16 flows while passing the outlet 14 of the liquid fuel nozzle 4, and the liquid fuel droplets injected through the outlet 14 are atomized by shearing forces of the airflow injected through the swirler 16. In other words, the outlet 14 of the liquid fuel nozzle 4 is just required to locate in such a position as enabling the liquid fuel droplets to be satisfactorily atomized by shearing forces of the airflow injected through the swirler 16. With the atomization of the liquid fuel droplets being thus promoted, ignition characteristics at the time of igniting the combustor can be improved and white smoke can be suppressed from generating when the combustor is ignited. It is further possible to promote mixing of the liquid fuel droplets with the combustion air, to ensure the effect of reducing black smoke generated, and to improve the combustion performance of the combustor.

In this embodiment, it is desired that about 1% of the combustion air supplied to the swirler 13 of the combustion burner 5 be supplied as the combustion air injected from the air supply nozzle 15. By holding the amount of the combustion air supplied to the air supply nozzle 15 so low, the combustion air can be supplied to the swirler 13 in sufficient amount.

Moreover, in this embodiment, the liquid fuel nozzle 4 is of the so-called pressure swirl injector structure comprising the nozzle tip 20 including the swirl chamber 19 formed therein to give a swirl component to the liquid fuel, the nozzle cover 18 for covering the nozzle tip 20, and the nozzle stay 21. Accordingly, no air is used to inject the liquid fuel and an air supply line can be dispensed with.

Furthermore, in this embodiment, the outlet 14 of the liquid fuel nozzle 4 is projected downstream in one position corresponding to the axis of the liquid fuel nozzle 4, i.e., in a central area of the downstream end wall surface 22 of the liquid fuel nozzle 4. If the outlet 14 is provided in plural in the downstream end wall surface 22, it is very difficult to make uniform the amount of the injected fuel in the radial direction of the combustion chamber 6. Also, providing the outlet 14 in an increased number causes a deviation in flow rates of the fuel injected through the outlets 14 when the liquid fuel is supplied at a low flow rate (under a low supply pressure), and results in a difficulty in making uniform the amount of the injected fuel in the radial direction of the combustion chamber 6. Further, if the diameter of a hole in the outlet 14 is reduced to make uniform the amount of the injected fuel, a trouble may occur in such a point that the fuel is more apt to cause carbonaceous deposits in the outlet hole and close a nozzle channel. In contrast, by injecting the fuel through one outlet 14 in the axial direction of the liquid fuel nozzle 4 as in this embodiment, it is possible to make uniform the amount of the injected fuel in the radial direction of the combustion chamber 6. Then, the metal temperature at an inner wall of the combustion chamber 6 is made uniform in the circumferential direction (namely, hot spots are less apt to occur), thus resulting in higher reliability. Additionally, by forming the outlet 14 of the liquid fuel nozzle 4 so as to inject the fuel in a conical shape, it is possible to make more uniform the amount of the injected fuel in the radial direction of the combustion chamber 6.

Second Embodiment

Figure 5:
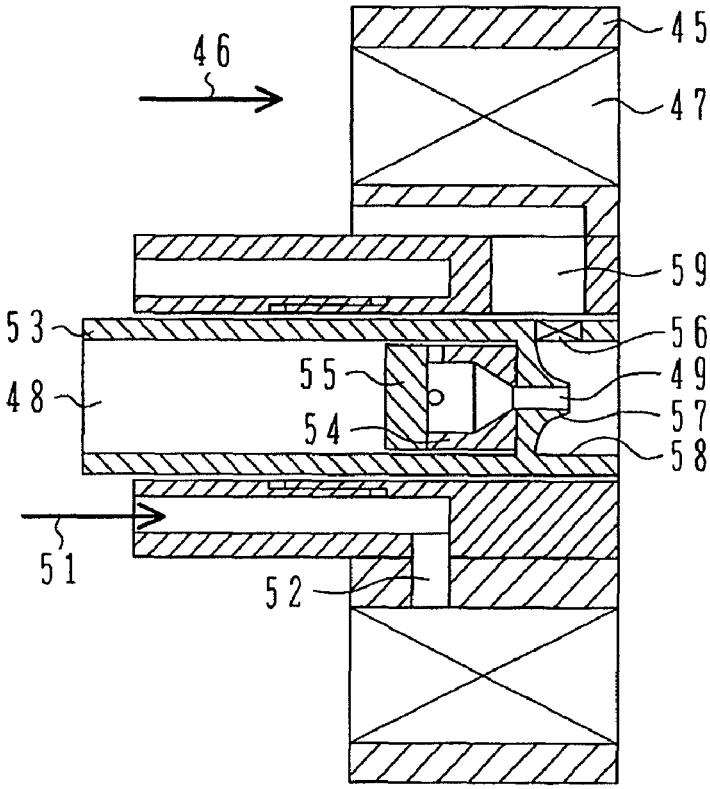
FIG. 5 is a side sectional view showing a detailed structure of a combustion burner according to a second embodiment of the present invention.

A combustion burner used in a gas turbine combustor according to a second embodiment will be described below with reference to FIG. 5. This embodiment is intended for a combustion burner capable of burning any of liquid fuel and gas fuel. As shown in FIG. 5, a combustion burner 45 includes a swirler 47 acting to give a swirl component to combustion air 46 supplied to the combustion chamber 6, and an air supply nozzle 59 for blowing a part of the combustion air toward an outlet 49 of a liquid fuel nozzle 48. A gas fuel hole 52 for injecting gas fuel 51 therethrough is formed in a sidewall of the swirler 47 substantially in its central area in the axial direction. The liquid fuel nozzle 48 is of the so-called pressure swirl injector structure comprising a nozzle cover 53, a nozzle tip 54, and a nozzle stay 55. Further, a swirler 56 acting to give a swirl component to a flow of air 46 injected from the air supply nozzle 59 of the combustion burner 45 is formed in a portion of the nozzle cover 53 in this embodiment. Additionally, a wall surface 57 is formed at a downstream end side of the liquid fuel nozzle 48 around the outlet 49 thereof, which is located to face the entry side of the combustion chamber 6, and the wall surface 57 extending from the swirler 56 to a projected distal end of the outlet 49 is in the form of a smooth curve. In this embodiment, surroundings of the outlet 49 of the liquid fuel nozzle 48 correspond to areas of the wall surface 57, which are located near the swirler 56. With such an arrangement, in this second embodiment, a space is formed around the outlet 49 of the liquid fuel nozzle 48 upstream of the outlet distal end in the injecting direction of the liquid fuel as in the first embodiment, while the space is defined by the wall surface 57.

The operation and advantages of the thus-constructed gas turbine combustor according to this embodiment will be described below.

As described above, a difference in thermal elongation occurs between the combustion burner 45 and the liquid fuel nozzle 48 depending on the operating conditions of the gas turbine. This causes a flow stagnation zone around the outlet 49 of the liquid fuel nozzle 48 and gives rise to a possibility that the amount of carbonaceous deposits around the outlet 49 of the liquid fuel nozzle 48 increases.

From the viewpoint of reducing environmental loads, it is a recent trend to reduce emissions of nitrogen oxides (referred to as "NOx" hereinafter) by carrying out premix combustion. However, a diffusive combustion burner used in combination with a premix combustion burner has a larger axial length, and the difference in thermal elongation between the combustion burner and the liquid fuel nozzle tends to increase correspondingly. This tendency leads to a possibility of increasing the amount of carbonaceous deposits around the outlet of the liquid fuel nozzle.

With this second embodiment, to avoid such a possibility, the swirler 56 acting to give a swirl component to the airflow injected toward the outlet 49 is formed in a portion of the nozzle cover 53 of the liquid fuel nozzle 48. Accordingly, the swirler 56 is also moved in match with the thermal elongation of the liquid fuel nozzle 48. In spite of the difference in thermal elongation being occurred between the combustion burner 45 and the liquid fuel nozzle 48, therefore, the positional relationship between the outlet 49 and the swirler 56 is held constant, and the flow stagnation zone where a circulation flow (i.e., a flow swirling in the axial direction of the combustor) is generated due to the difference in thermal elongation between the combustion burner 45 and the liquid fuel nozzle 48 is less apt to be formed in an area inwardly of the swirler 56. As a result, it is possible to suppress the carbonaceous deposits around the outlet of the liquid fuel nozzle.

Figure 6:
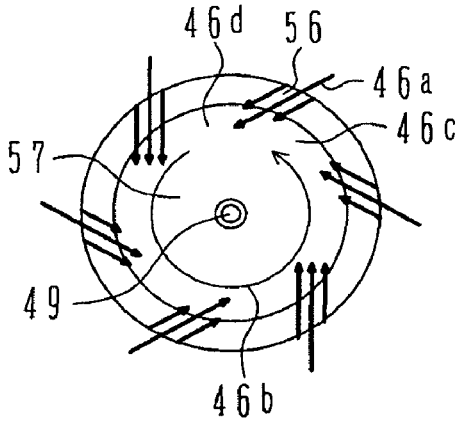
FIG. 6 is a partial enlarged view of a nozzle cover in FIG. 5, as viewed from below a combustor.

FIG. 6 is a partial enlarged view of the nozzle cover 53 in FIG. 5, as viewed from below the combustor. With this embodiment, as seen from FIG. 6, swirling flows 46*b* are formed by airflows 46*a* blown through six swirlers 56 formed around the outlet 49 in the circumferential direction, to thereby prevent liquid fuel droplets from being deposited on the wall surface 57 around the outlet 49. However, there is still a possibility that, in areas where the swirlers 56 are formed, circulation flows 46*c*, 46*d* swirling in the circumferential direction of the liquid fuel nozzle 48 are generated by the airflows 46*a* injected through the swirlers 56. In this embodiment, to avoid such a possibility, the outlet 49 of the liquid fuel nozzle 48 is formed to project downstream by a desired distance from the perimeter of the wall surface 57 at the downstream end side of the liquid fuel nozzle 48 so that the space is formed around the outlet 49 of the liquid fuel nozzle 48 upstream of the outlet distal end in the direction in which the liquid fuel is injected. This arrangement is able to prevent the liquid fuel droplets from colliding and depositing on the wall surface 57 and an inner circumferential wall 58 of the nozzle cover 53 formed downstream of the outlet 49, and to suppress the carbonaceous deposits. More specifically, the outlet 49 of the liquid fuel nozzle 48 is formed so as to project such that the outlet distal end is located downstream of the area where the circulation flows 46*c*, 46*d* are generated.

Further, the wall surface 57 at the downstream end side of the nozzle cover 53 is in the form of a smooth curve from the perimeter near the outlet side of the swirler 56 to the distal end of the outlet 49. Accordingly, the circulation flow is less apt to generate around the outlet 49, and the carbonaceous deposits can be suppressed.

The length of the injection hole of the air supply nozzle 59 as a part of the combustion burner 45 in the axial direction of the combustor is set larger than the axial length of the swirler 56 formed in the liquid fuel nozzle 48. This setting is in consideration of the difference in thermal elongation between the combustion burner 45 and the liquid fuel nozzle 48. By so setting the length of the injection hole of the air supply nozzle 59 in the axial direction of the combustor, the swirler 56 can be prevented from being closed in spite of the difference in thermal elongation between the combustion burner 45 and the liquid fuel nozzle 48. As a result, over a wide operating range of the gas turbine, atomization of the liquid fuel droplets injected through the outlet 49 can be promoted by the air injected through the swirler 56, and the combustion performance of the combustor can be maintained at a satisfactory level for a long term.

Moreover, in this embodiment, the gas fuel is supplied to the combustion burner 45 substantially in the central area of the swirler 47 in the axial direction. This leads to a possibility that, when the combustion burner 45 of this embodiment is operated using only the gas fuel, the outlet 49 of the liquid fuel nozzle 48 located on the upstream side may be so heated as to be damaged by the combustion gases produced in the combustion chamber 6 on the downstream side within the combustor. With this embodiment, however, because of the structure of blowing the air injected from the air supply nozzle 59 to the outlet 49 of the liquid fuel nozzle 48, the outlet 49 is cooled by the air injected through the swirler 56 formed in the nozzle cover 53 even when only the gas fuel is supplied for the air supply nozzle 59 without using the liquid fuel. Accordingly, the possibility of damaging the outlet 49 of the liquid fuel nozzle 48 by burning can be reduced.

Third Embodiment

Figure 7:
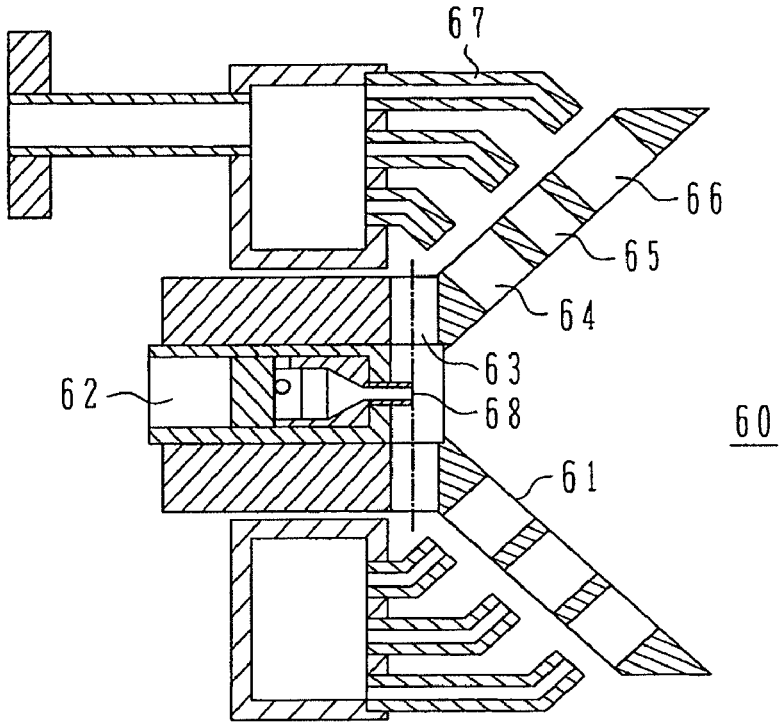
FIG. 7 is a side sectional view showing a detailed structure of a combustion burner according to a third embodiment of the present invention.

A third embodiment of the present invention will be described below. FIG. 7 is a side sectional view showing a detailed structure of a combustion burner according to this third embodiment.

As shown in FIG. 7, a mixing chamber wall 61 defining a mixing chamber 60 is formed in a hollow conical shape gradually spreading in a direction toward the combustion chamber. A liquid fuel nozzle 62 for injecting liquid fuel is disposed at the apex of the conical-shaped mixing chamber wall 61 substantially in coaxial relation to the axis of the mixing chamber wall 61. Also, air inlet holes 63, 64, 65 and 66, each serving as an air supply nozzle, are formed in the mixing chamber wall 61 at plural positions in the circumferential direction thereof. Layout of the air inlet holes 63, 64, 65 and 66 for introducing the combustion air supplied from the compressor 1 to the mixing chamber 60 is set such that those holes are bored in plural stages (four in the illustrated example) in the axial direction of the mixing chamber successively in the order named from the upstream side (left side in FIG. 7) as viewed in the axial direction.

An angle at which the combustion air is introduced to the mixing chamber 60 through each of the air inlet holes 63, 64, 65 and 66 is set to direct the combustion air from the peripheral side of the mixing chamber wall 61 toward the axis of the mixing chamber 60. Around the mixing chamber wall 61 upstream of the air inlet holes 64, 65 and 66, a plurality of gas fuel nozzles 67 for injecting gas fuel are disposed in one-to-one opposite relation to the air inlet holes 64, 65 and 66. The gas fuel nozzles 67 are each constructed to be able to inject the gas fuel substantially coaxially with the axis of corresponding one of the air inlet holes 64, 65 and 66.

Further, an outlet 68 of the liquid fuel nozzle 62 disposed upstream of the mixing chamber 60 in coaxial relation is formed so as to project until a position substantially crossing an extension of the axis (indicated by a one-dot-chain line in FIG. 7) of each air inlet hole 63 formed in the mixing chamber 60 at the most upstream side. Stated another way, in this embodiment, the air inlet hole 63 serves as an air supply nozzle for blowing the air toward the outlet 68 of the liquid fuel nozzle 62.

During the combustion using the liquid fuel, the liquid fuel droplets injected through the outlet 68 are burnt in the mixing chamber 60 after being mixed with the combustion air introduced through the air inlet holes 63, 64, 65 and 66. In an upstream end area of the mixing chamber 60 where the liquid fuel nozzle 62 is disposed, various circulation flows are generated due to airflows introduced through plural air inlet holes 63 depending on the operating conditions of the gas turbine. However, because the outlet 68 of the liquid fuel nozzle 62 is projected toward the entry side of the mixing chamber 60, a space is formed around the outlet 68 upstream of the outlet distal end, i.e., on the backward side opposed to the direction in which the liquid fuel is injected. In other words, the outlet 68 is in the form projecting downstream from an area where the circulation flows are generated. Therefore, small droplets of the liquid fuel injected from the liquid fuel nozzle 62 are less apt to be carried with the circulation flows, and carbonaceous deposits on surrounding surfaces of the outlet of the liquid fuel nozzle can be suppressed.

Further, as in the first and second embodiments, the outlet 68 of the liquid fuel nozzle 62 is disposed with the outlet distal end located in a position substantially crossing the extension of the axis of each air inlet hole 63 (air supply nozzle). With such an arrangement, the liquid fuel droplets injected through the outlet 68 are atomized by shearing forces of the airflows injected through the plural air inlet holes 63 at the most upstream side, and the atomization of the liquid fuel droplets is further promoted by the airflows injected through the air inlet holes 64, 65 and 66 located downstream of the air inlet holes 63. Accordingly, ignition characteristics at the time of igniting the combustor can be improved and white smoke can be suppressed from generating when the combustor is ignited. It is further possible to promote mixing of the liquid fuel droplets with the combustion air, to ensure the effect of reducing black smoke generated, and to improve the combustion performance of the combustor.

During the combustion using the gas fuel, the gas fuel injected through the gas fuel nozzles 67 is primarily mixed with the combustion air within the air inlet holes 64, 65 and 66. Then, the gas fuel is burnt after being secondarily mixed with the combustion air under actions of circulation flows generated when the gas fuel and the combustion air are injected into the mixing chamber 60. As a result, mixing of the air and the gas fuel is sufficiently promoted and NOx emissions can be reduced correspondingly.

In addition, the gas fuel is not supplied to the air inlet holes 63. During the combustion using the gas fuel, therefore, the liquid fuel nozzle 62 is cooled by the air introduced through the air inlet holes 63, and a possibility of damage of the liquid fuel nozzle 62 by burning can be reduced.

Fourth Embodiment

Figure 8:
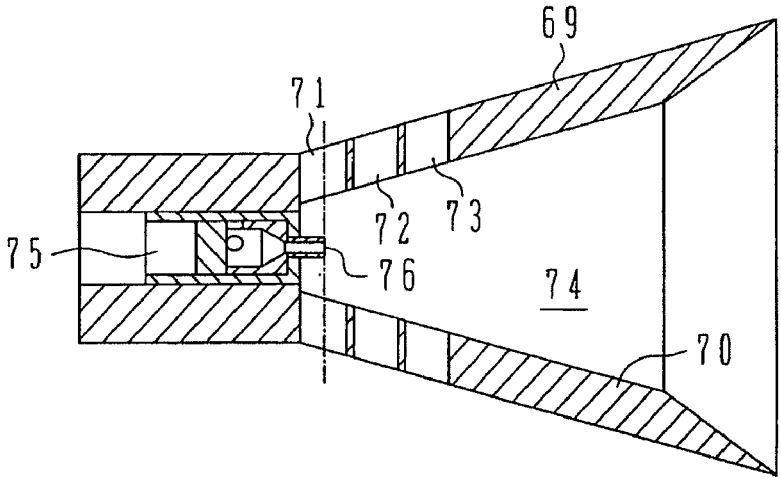
FIG. 8 is a side sectional view showing a detailed structure of a combustion burner according to a fourth embodiment of the present invention.

A fourth embodiment of the present invention will be described below. FIG. 8 is a side sectional view showing a detailed structure of a combustion burner according to this fourth embodiment. In a combustion burner 69 of this embodiment, as shown in FIG. 8, an angle at which a mixing chamber wall 70 gradually spreads is set smaller than the spreading angle of the mixing chamber wall 61 in the third embodiment, while the axial length of the mixing chamber wall 70 is set longer than that of the mixing chamber wall 61. Then, air inlet holes 71, 72 and 73, each serving as an air supply nozzle, are formed in an upstream area of the mixing chamber wall 70 in concentrated layout. As in the third embodiment, the air inlet holes 71, 72 and 73 are formed such that an angle at which the combustion air is introduced to the mixing chamber 74 through each air inlet hole is set to direct the combustion air from the peripheral side of the mixing chamber wall 70 toward the axis of the mixing chamber 74.

Further, an outlet 76 of a liquid fuel nozzle 75 disposed upstream of the mixing chamber 74 in coaxial relation is formed so as to project until a position substantially crossing an extension of the axis (indicated by a one-dot-chain line in FIG. 8) of the air inlet hole 71 formed in the mixing chamber 74 at the most upstream side. In this embodiment, therefore, the air inlet hole 71 serves as an air supply nozzle for blowing the air toward the outlet 76 of the liquid fuel nozzle 75. In an upstream end area of the mixing chamber 74, circulation flows are generated due to airflows introduced through plural air inlet holes 71. However, because a space is formed around the outlet 76 of the liquid fuel nozzle 75 upstream of the outlet distal end in the injecting direction of the liquid fuel, the outlet distal end is spaced downstream from surrounding surfaces of the outlet 76 of the liquid fuel nozzle 75, which are positioned to face the mixing chamber 74 in communication with the combustion chamber. Thus, the outlet 76 is in the form projecting downstream from the upstream area where the circulation flows are generated, and carbonaceous deposits can be suppressed as in the third embodiment.

Further, as in the third embodiment, since the outlet 68 of the liquid fuel nozzle 62 is disposed with the outlet distal end located in a position substantially crossing the extension of the axis of each air inlet hole 71 (air supply nozzle), the liquid fuel droplets injected through the outlet 68 are atomized by shearing forces of the airflows injected through plural air inlet holes 71, and the atomization of the liquid fuel droplets is further promoted by the airflows injected through the air inlet holes 72, 73 located downstream of the air inlet holes 71. Further, since the mixing chamber 74 is formed to have a longer axial length in this embodiment, the atomized liquid fuel droplets are subjected to droplet mixing and complete evaporation with the high-temperature combustion air, and premix combustion can be performed downstream of the mixing chamber 74.

According to this embodiment, as described above, since the outlet 76 of the liquid fuel nozzle 75 is projected downstream in the axial direction of the liquid fuel nozzle 75, carbonaceous deposits on the surrounding surfaces of the outlet 76 of the liquid fuel nozzle 75 can be suppressed. Further, by utilizing shearing forces of the combustion air, the liquid fuel droplets injected through the outlet 76 are evaporated with promoted atomization. As a result, premix combustion can be performed and NOx emissions can be reduced.

Fifth Embodiment

Figure 9:
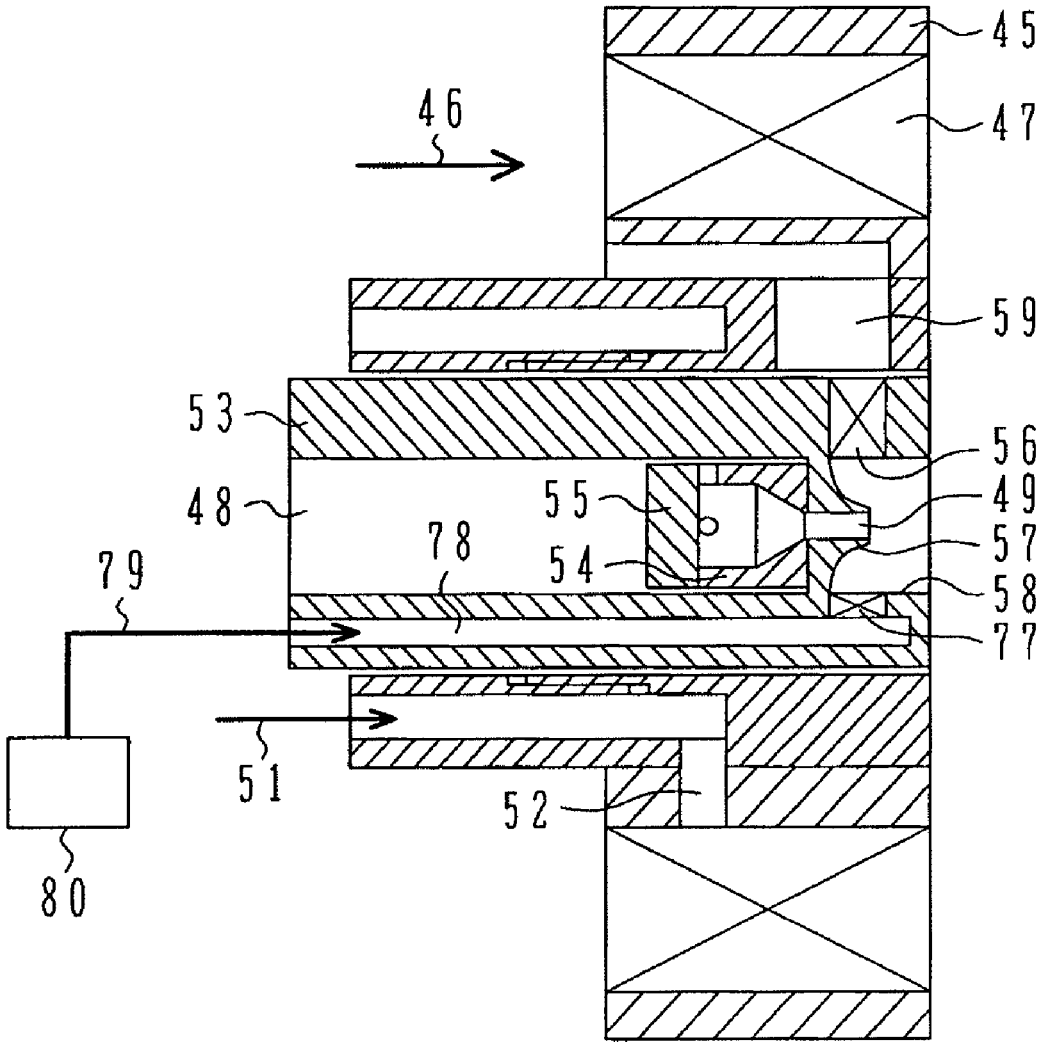
FIG. 9 is a side sectional view showing a detailed structure of a combustion burner according to a fifth embodiment of the present invention.

A fifth embodiment of the present invention will be described below. In the first to fourth embodiments, a part of the combustion air is utilized as air supplied to the outlet of the liquid fuel nozzle. On the other hand, in this fifth embodiment, air is further supplied through another air supply line in addition to a part of the combustion air supplied to the swirler 45. In FIG. 9, this fifth embodiment is applied to the components of the second embodiment (FIG. 5), and main components of this fifth embodiment are the same as those shown in FIG. 5.

In this fifth embodiment, the swirler 56 acting to give a swirl component to the airflow injected from the air supply nozzle 59 of the combustion burner 45 is formed in a portion of the nozzle cover 53. Then, in addition to the air supply nozzle 59, an injected air swirler 77 and an injected air channel 78 are also formed in the nozzle cover 53, and an injected air supply line 80 serving as injected air supply means is connected to the injected air channel 78 for supply of injected air 79 to the injected air swirler 77.

The operation and advantages of the thus-constructed fifth embodiment will be described below.

In this fifth embodiment, in addition to the operation of the second embodiment, injected air under higher pressure than the combustion air is supplied to the injected air swirler 77 at the time of igniting the combustor. Therefore, carbonaceous deposits on surrounding surfaces of the outlet 49 of the liquid fuel nozzle 48, including the outlet 49 itself, can be suppressed.

Further, the liquid fuel droplets injected through the outlet 49 is more finely atomized by shearing forces of the air injected at high speed through the injected air swirler 77. As compared with the case using only the air injected through the air supply nozzle 59, therefore, ignition characteristics at the time of igniting the combustor can be further improved and white smoke can be more reliably suppressed from generating when the combustor is ignited.

The first to fifth embodiments have been described in connection the case using the so-called simplex pressure swirl injector in which the liquid fuel nozzle has a single outlet. However, the present invention can also be applied without problems to the so-called duplex pressure swirl injector in which double orifices are arranged in concentrically combined layout. Additionally, the present invention is further applicable to other types of liquid fuel nozzles, such as an air blast injector, than the pressure swirl injector.

Thus, the present invention is widely available as an effective countermeasure for preventing carbonaceous deposits on an outlet itself and surrounding surfaces of the liquid fuel nozzle in various types of combustion burners for burning liquid fuel, including a gas turbine combustor.

What is claimed is:

1. A combustor for mixing combustion air and liquid fuel injected from a liquid fuel nozzle and for burning a gas mixture of the liquid fuel and the combustion air, wherein the liquid fuel nozzle comprises a nozzle tip for giving a swirl component to the liquid fuel, and a nozzle cover for covering the nozzle tip, the nozzle cover having an outlet for injecting the liquid fuel in an axial direction of the liquid fuel nozzle;

wherein the combustor comprises an air supply nozzle disposed around the liquid fuel nozzle, the air supply nozzle having an injection hole for injecting a part of the combustion air toward the axis of the liquid fuel nozzle, and the air injecting direction from the injection hole of the air supply nozzle is set perpendicular to the axis of the liquid fuel nozzle;

wherein the outlet is formed such that it is projected downstream in the axial direction of the liquid fuel nozzle until a position crossing an extension of an axis of the injection hole; and wherein in a cross-section passing through the axis of the liquid fuel nozzle, a wall surface at the downstream end side of the liquid fuel nozzle is in the form of a smooth curve from an outermost portion thereof to the outlet.

2. The combustor according to claim 1, wherein the curve forming the wall surface at the downstream end side of the liquid fuel nozzle is set perpendicular to the axis of the liquid fuel nozzle, at the outermost portion of the liquid fuel nozzle.

3. The combustor according to claim 1, wherein the curve forming the wall surface at the downstream end side of the liquid fuel nozzle is set parallel to the axis of the liquid fuel nozzle, at the outlet thereof.

* * * * *